US010285472B2

(12) United States Patent
Wyatt et al.

(10) Patent No.: US 10,285,472 B2
(45) Date of Patent: May 14, 2019

(54) LACE TIGHTENER INCORPORATING SMA WIRE

(71) Applicant: Recovery Force, LLC, Fishers, IN (US)

(72) Inventors: Matthew W. Wyatt, Fishers, IN (US); Brian J. Stasey, Fishers, IN (US); Mark Gummin, Silverton, OR (US); Ryan Hamilton, Livingston, MT (US)

(73) Assignee: Recovery Force, LLC, Fishers, IN (US)

( * ) Notice: Subject to any disclaimer, the term of this patent is extended or adjusted under 35 U.S.C. 154(b) by 184 days.

(21) Appl. No.: 15/498,948

(22) Filed: Apr. 27, 2017

(65) Prior Publication Data

US 2017/0318908 A1 Nov. 9, 2017

Related U.S. Application Data

(60) Provisional application No. 62/332,293, filed on May 5, 2016.

(51) Int. Cl.
*A43C 11/16* (2006.01)
*A43C 9/08* (2006.01)
(Continued)

(52) U.S. Cl.
CPC ..... *A43C 11/165* (2013.01); *A43B 3/0005* (2013.01); *A43B 3/0015* (2013.01); *A43C 11/008* (2013.01)

(58) Field of Classification Search
CPC ... A43C 11/165; A43C 11/008; A43B 3/0015; A43B 3/0005
See application file for complete search history.

(56) References Cited

U.S. PATENT DOCUMENTS 9,664,211 B2 * 5/2017 Tupper ..... F16B 1/0014
9,730,494 B1 * 8/2017 Feinstein ..... A43C 11/1493
(Continued)

*Primary Examiner* — Robert Sandy
*Assistant Examiner* — Rowland Do
(74) *Attorney, Agent, or Firm* — Maginot, Moore & Beck, LLP

(57) ABSTRACT

A lace-tightening device for a shoe lace in a shoe comprises a rotating cam within a housing disposed within the shoe. The cam is connected to the opposite ends of the shoe lace and includes an outer surface for receiving the shoe lace as the cam rotates to pull the lace. A driven gear disposed is rotatably coupled to the cam through a one-way clutch configured so that rotation of the driven gear in one direction rotates the cam in the one direction, thereby tightening the shoe lace connected to the rotating cam. A ratchet arm is slidably disposed within the housing and includes linear teeth arranged to engage the teeth of the driven gear as the ratchet arm translates in a linear direction. to rotate the gear in the one direction. The ratchet arm is pulled by at least one shape memory alloy (SMA) wire attached at one end to the ratchet arm and at its opposite end to a controller. The controller is configured to execute a power cycle to energize and deenergize the SMA wire so that the wire sequentially shrinks and returns to its original length to thereby sequentially translate the ratchet arm in the linear direction, and ultimately to incrementally pull and tighten the shoe lace. The controller repeats the cycle a number of times until the lace reaches a tightness desired by the user.

13 Claims, 11 Drawing Sheets

(51) Int. Cl.
*A43B 3/00* (2006.01)
*A43C 11/00* (2006.01)

(56) References Cited

U.S. PATENT DOCUMENTS

2002/0100188 A1* 8/2002 Jacques ..... A43B 3/0005
36/50.1
2015/0289596 A1* 10/2015 Beers ..... A43C 11/22
36/50.1

* cited by examiner

LACE TIGHTENER INCORPORATING SMA WIRE

PRIORITY CLAIM

This application is a utility filing from and claims priority to U.S. provisional application No. 62/332,293, filed on May 5, 2016, the entire disclosure of which is incorporated herein by reference.

BACKGROUND

The traditional shoe uses shoe laces threaded through eyelets to tighten the shoe around the wearer's foot. Similar lacing systems are used in other apparel, accessories and equipment to tighten the component on the user. Newer closure systems have been developed to replace the traditional shoe lace that must be hand-tightened and tied by the user (or his/her mother). One such system is the BOA closure sold by BOA Technology, Inc. The BOA closure utilizes a reel and spool system operable to tighten a lace, cable or wire that is wound through fittings on the component.

One example is shown in FIG. 1 in which a shoe S includes a lacing system 10 that incorporates a BOA closure 12. The BOA closure may be constructed as disclosed in U.S. Pat. No. 7,950,112 (the '112 patent) and U.S. Pat. No. 7,954,204 (the '204 patent), the entire disclosures of which are incorporated herein by reference. The lacing system 10 may be configured as shown in FIG. 2 in which the lace or cable 15 extends on either side of the closure 12 and wraps around guides 20, 23, 24 and 26 that are mounted to the shoe, such as by mounting pads 21. A dial 13 of the closure 12 is manually rotated to wind the cable 15 onto a spool within the closure, thereby shortening the effective length of the cable and tightening it about the guides. The closure includes a one-way clutch mechanism that holds the spool in its rotational position with each rotation of the dial. The closure 12 further includes a release mechanism that releases the one-way clutch to allow the cable 15 to unwind on the spool a sufficient amount to release the tension in the cable and to allow the cable to be pulled further out of the spool as required to fully loosen the closure system.

The BOA closure 12 is an improvement over the traditional shoe lace for several reasons. Perhaps the most significant improvement is that it eliminates the need to manually tie the ends of the shoe lace together while maintaining sufficient tension in the lace to achieve a desirably tight fit of the shoe on the foot. The BOA closure 12 also allows the cable tension, and thus the tightness of the lacing system, to be incrementally adjusted until just the right tightness is achieved.

However, even as the BOA closure system is an improvement over manual shoe laces, it still requires manual intervention to adjust the lace tension "on the fly". If the lacing system 10 needs to be tightened during an activity, the user must cease the activity and then manually manipulate the BOA closure 12 as required to reduce or increase the tightness of the lacing system. Tightening may only require a single click of the dial 13, but loosening the lacing system requires completely disengaging the BOA closure 12 and then re-tightening by manually rotating the dial.

SUMMARY OF THE DISCLOSURE

A lace-tightening device for a shoe lace in a shoe comprises a housing configured to be mounted within the shoe, the housing defines at least one opening for receiving the opposite ends of the shoe lace. A rotating cam is disposed within the housing and is adapted for connection to the opposite ends of the shoe lace. The cam includes an outer surface for receiving the shoe lace as the cam rotates to pull the lace. A driven gear disposed within the housing is rotatably coupled to the cam through a one-way clutch configured so that rotation of the driven gear in one direction rotates the cam in the one direction, thereby tightening the shoe lace connected to the rotating cam.

In one aspect, a ratchet arm is slidably disposed within the housing and includes linear teeth arranged to engage the teeth of the driven gear as the ratchet arm translates in a linear direction. This translation of the ratchet arm causes the driven gear to rotate in the one direction. The ratchet arm is pulled by at least one shape memory alloy (SMA) wire attached at one end to the ratchet arm and at its opposite end to a controller. The controller is configured to execute a power cycle to energize and deenergize the SMA wire so that the wire sequentially shrinks and returns to its original length to thereby sequentially translate the ratchet arm in the linear direction. On each cycle the ratchet arm incrementally rotates the driven gear and cam, to incrementally pull and tighten the shoe lace. The controller repeats the cycle a number of times until the lace reaches a tightness desired by the user.

In another aspect, a lacing system is provided that comprises a lace formed of a shape memory alloy (SMA) wire adapted to change length upon application of an electrical current and a tightening device for tightening the lace. The tightening device includes a spool for receiving the ends of the SMA wire lace and for winding the SMA wire lace upon rotation of the spool, a base rotatably supporting the spool and a rotary dial mounted on the base and configured with the base and spool to form a one-way clutch to permit rotation of the spool in one direction to tighten the SMA wire lace around the spool and to hold the spool in a particular rotational orientation. The lacing system further includes a positive electrical contact and a negative or ground electrical contact disposed within the tightening device in continuous electrically conductive contact with respective ends of the SMA wire. A positive power wire is electrically connected to the positive electrical contact and a negative or ground electrical wire is electrically connected to the negative or ground contact. A controller is connected to the positive power wire and negative or ground electrical wire to apply electric current to the wires and thereby apply electrical current to the SMA wire lace.

DETAILED DESCRIPTION

Figure 1:
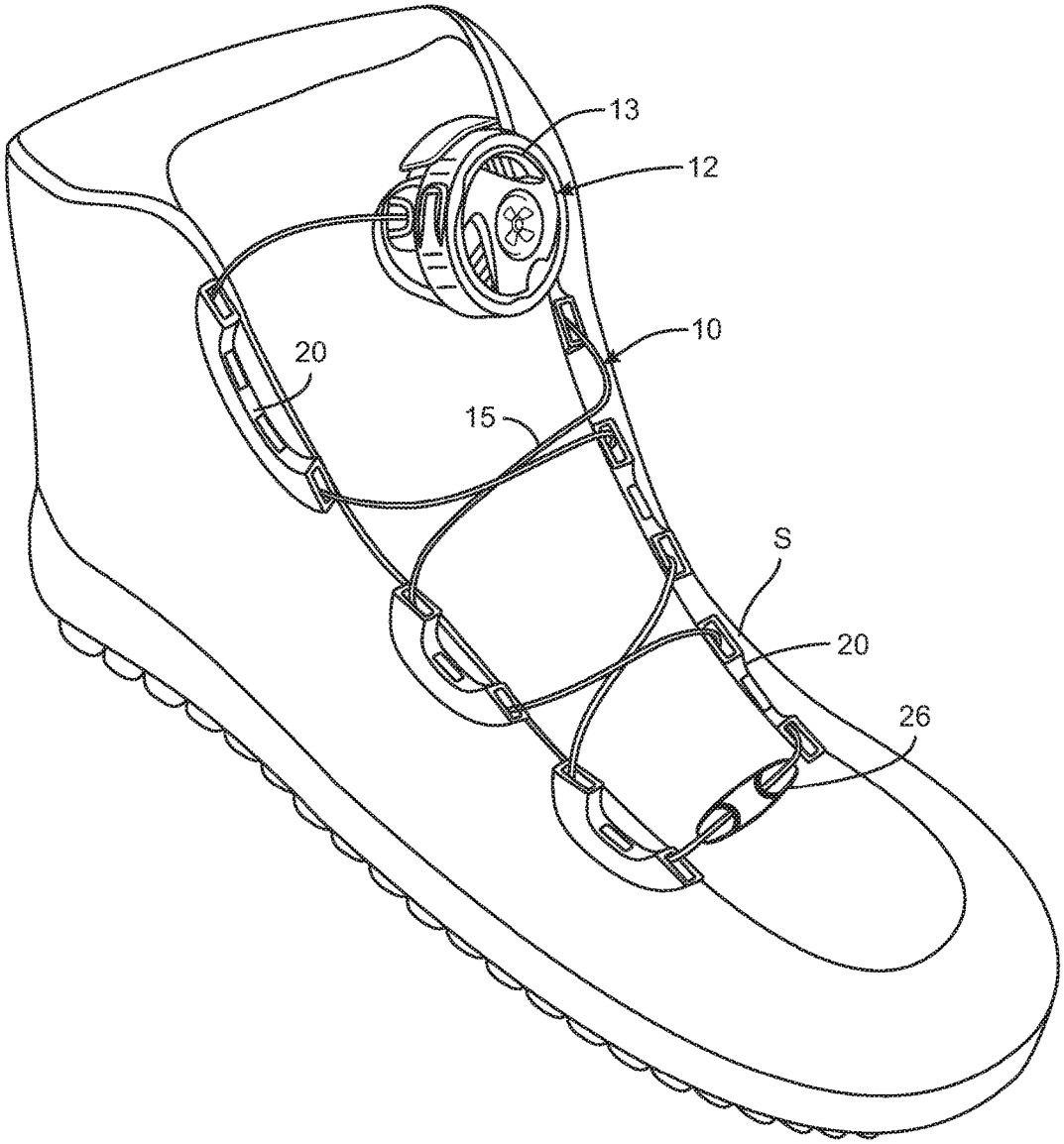
FIG. 1 is a perspective view of a shoe with a lacing system incorporating a BOA closure.
Figure 2:
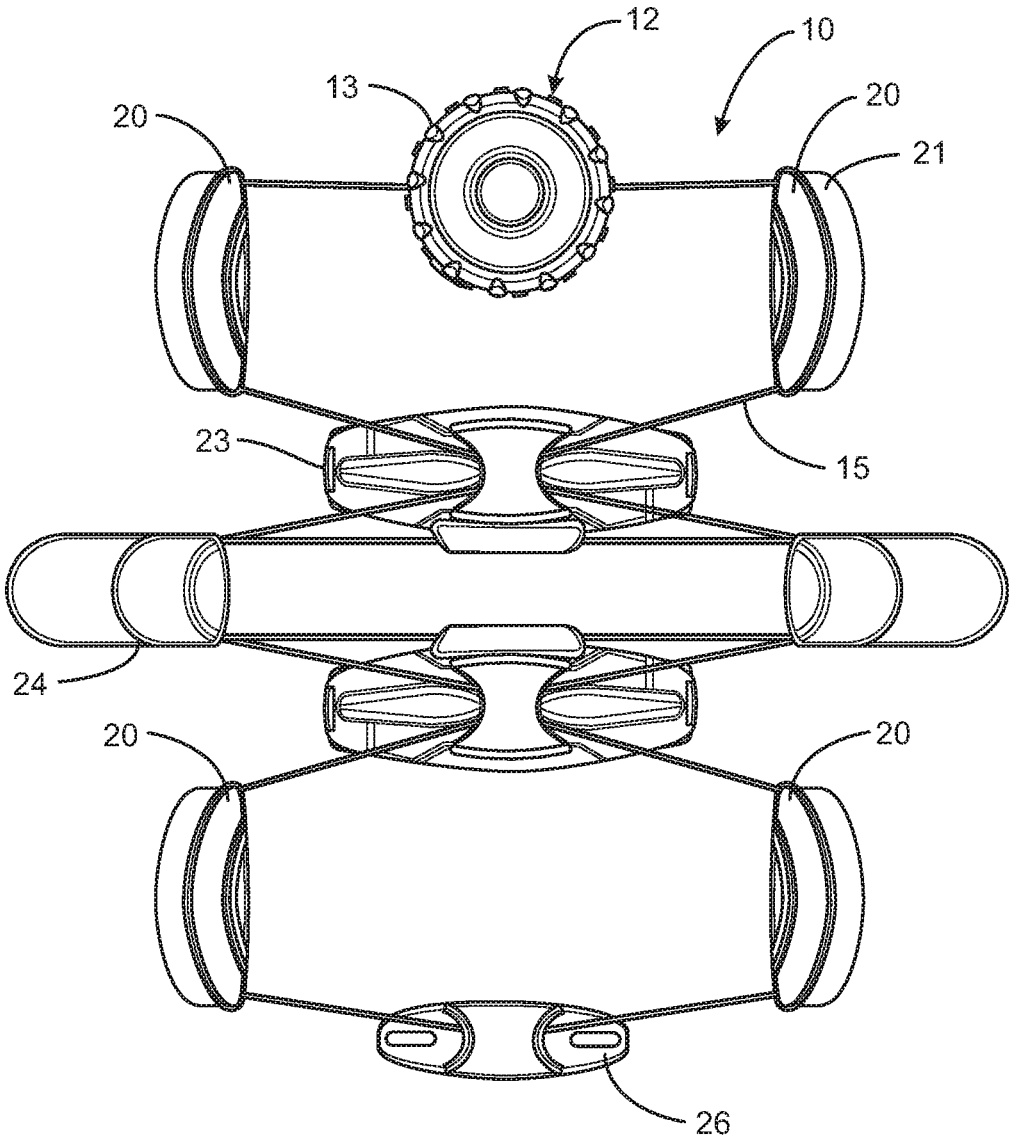
FIG. 2 is a top view of a lacing system incorporating a BOA closure.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains According to one aspect of the present invention, the lacing system 10 incorporates a shape memory alloy (SMA) wire and a controller to permit automatic or remote adjustment of the tension in the lacing system. In one embodiment, the lace or cable 15 is replaced with an SMA wire, such as a wire formed of Nitinol. Nitinol is an alloy that can change shape or length based on temperature. The temperature of a Nitinol component can be increased by external application of heat, as implemented in arterial stents implanted within the human body. Alternatively, the temperature of a Nitinol component can be increased by running a current through the component and utilizing the resistance of the wire to generate heat. A Nitinol wire is well-suited for heating by electrical conduction.

In one aspect of the invention, an electrical current is applied to a Nitinol cable in a lacing system to change the length of the Nitinol cable. Since the resistance of the Nitinol wire changes as its length changes, the exact change in length can be determined and used to provide precise control of the tightening of the lacing system 10. In one embodiment shown in FIGS. 3*a*-3*b* and 4, an SMA wire 15 is wound within a modified BOA closure 12' that incorporates electrical contacts 30 for providing power to the SMA wire. The BOA closure 12' includes a base 40 that receives the spool 41 and mates with a rotary dial 42. Each of these components operates as BOA closure components disclosed in the '112 and '204 patents discussed above and incorporated herein by reference. In particular, the SMA wire 15 is wound around the spool 41 in the manner of the lace of the lacing system disclosed in the '112 and '204 patents, and the base, spool and dial interact as disclosed in those patents to tension the SMA wire 15 wound around the spool. The base and dial interact to form a one-way clutch that permits rotation of the spool in one direction to tighten the lace or wire and holds the spool in the particular rotational orientation. The base and dial further interact in another relative configuration to release the spool, such as by pulling the dial outward relative to the base to release the one-way clutch.

Figure 3B:
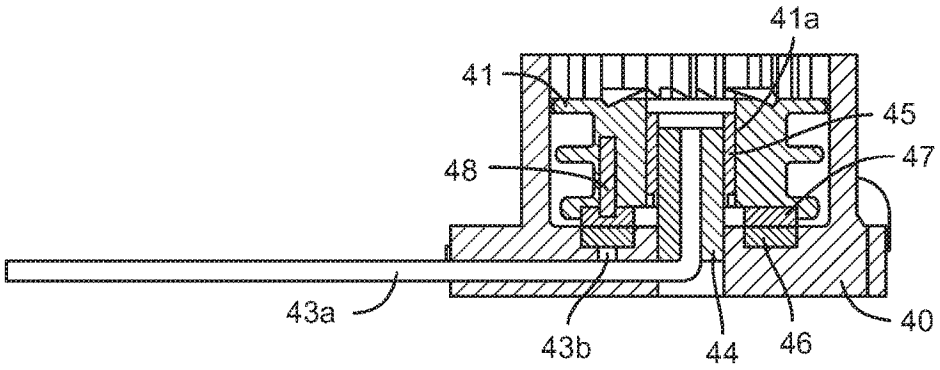
FIG. 3*b* is a cross-sectional view of the improved BOA closure shown in FIG. 3*a*.
Figure 3A:
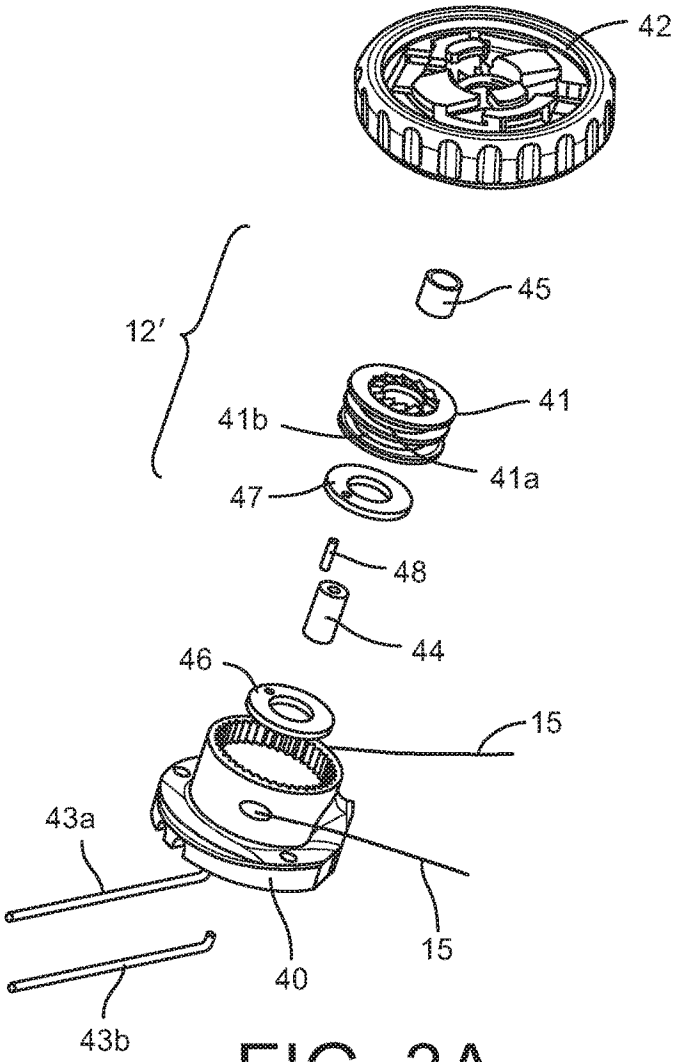
FIG. 3*a* is a perspective view of an improvement to the lacing system with the BOA closure of FIGS. 1-2, incorporating a shape memory material within the BOA closure.

In the present embodiment, the lace is replaced by an SMA wire 15, thus the present disclosure contemplates providing electrical power to the SMA wire to provide further tensioning of the SMA wire after the BOA closure has been manipulated to apply a pre-tension to the wire. Thus, the modified BOA closure 12' is configured to receive a positive power wire 43*a* and a ground wire 43*b* for electrical conductive contact with the SMA wire 15 when it is wound around the spool 41. The two wires are connected to respective contacts 30 for electrical contact with the ends of the SMA wire 15 fixed within the spool 41. In particular, the electrical contacts are configured to make electrical contact with the wire fixed within openings 41*a*, 41*b* in the spool. One of the electrical contacts 30 for the positive power wire 43*a* incorporates an axle 44 on which the spool is rotatably mounted. As shown in FIG. 3*b* the positive wire 43*a* is fixed within the axle 44. The axle is rotatably seated within a sleeve 45 that is fixed within the spool 41 so that the spool can rotate about the axle. The axle and sleeve are electrically conductive. The sleeve bears against the SMA wire threaded through the openings 41*a*.

The negative or ground wire 43*b* is fixed within the base 40 and in electrical contact with a conductive washer 46 embedded within the base 40. A second washer 47 is embedded within the spool 41 so that the second washer rotates with the spool. A pin 48 is in electrical contact with the second washer 47 and arranged to contact the SMA wire threaded through the second openings 41*b*. The two washers 46, 47 maintain electrical contact as the spool 41 rotates relative to the base 40 upon rotation of the dial 42. Likewise, the washer pin 48 and spool sleeve 45 maintain electrical contact with the respective ends of the SMA wire 15 engaged within the spool 41.

Figure 4:
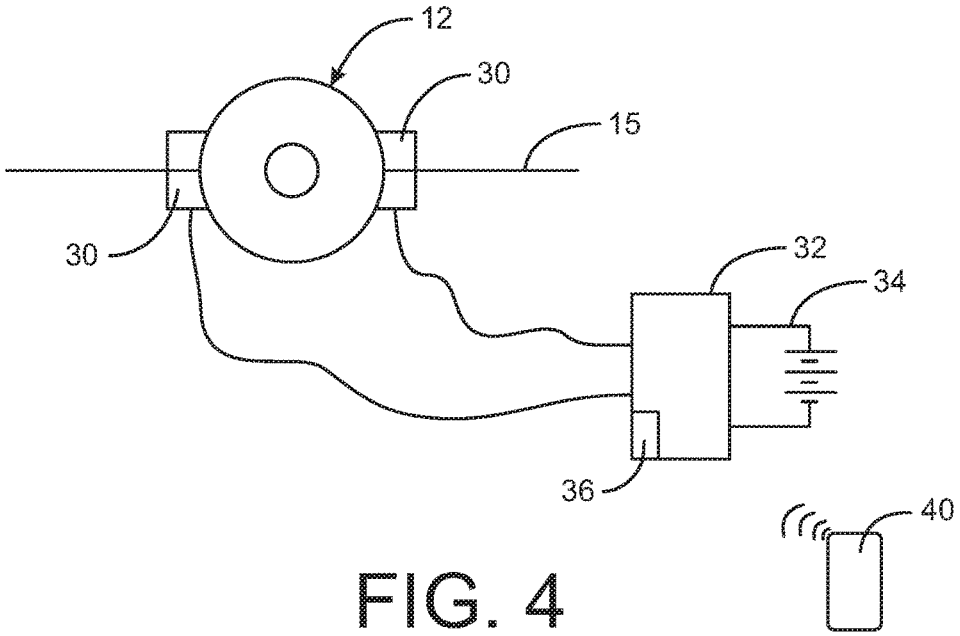
FIG. 4 is a schematic of a further embodiment of the improvement to a lacing system.

It can thus be appreciated that the two electrical contacts—one in the form of the contacting washers and the other in the form of an axle and sleeve—are configured to maintain continuous electrical contact even as the spool 41 is rotated during tightening of the BOA closure 12' by manually rotating the dial 42. As shown in FIG. 4, the electrical contacts 30 are connected to a controller 32 and a power supply 34, such as an on-board battery. The controller 32 can be mounted within the shoe, such as the shoe S in FIG. 1, or other article utilizing the lacing system 10. The controller is operable to supply electric current to the Nitinol wire 15, by way of the washers, axle and sleeve, to contract the wire. The wire is sufficiently strong to be incorporated into the BOA closure 12 and operated independent of the controller 32 to at least initially tighten the lacing system. At a certain level of tightness the controller 32 can be used to apply a current to the Nitinol wire to contract the wire and apply further tension to the lacing system. It is further contemplated that the Nitinol wire can be "pre-tensioned" by applying a small current to the wire, prior to fully tensioning the lacing system using the BOA closure 12. With the "pre-tension" any subsequent adjustment of the tension of the lacing system and compression of shoe (or other component) can include a reduction in tension.

Figure 5:
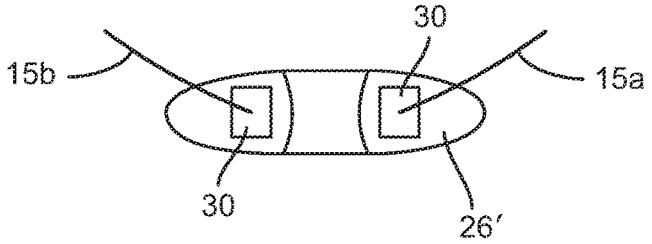
FIG. 5 is a schematic of a further embodiment of the improvement to a lacing system.

In the embodiments of FIGS. 3-4, the Nitinol wire 15 is in sliding contact with the electrical contacts 30. A close sliding contact can be maintained by positioning the electrical contacts within the closure 12 itself or by providing a sleeve to retain the wire in electrical contact with the contacts. Alternatively, the Nitinol wire can be anchored at the end of the lacing system 10 farthest from the closure 12, such as at the guide 26. Thus, a modified guide 26' can be provided as shown in FIG. 5 in which the ends of the Nitinol wire segments 15*a*, 15*b* are fixed to the electrical contacts 30.

The controller 32 (FIG. 4) can include a sensor 36 configured to sense a condition of the cable or wire 15 from which the change in length of the wire can be determined. In one specific embodiment, the sensor 36 is configured to measure the resistance of the Nitinol wire 15. Since the resistance of the Nitinol wire changes as its length changes, the measured resistance can provide an accurate indication of the change in length. The controller 32 can incorporate software or firmware configured to translate this measured change in length to a baseline tension value from which future changes in tension can be determined. The controller 32 can also include software that can establish pre-programmed conditions for tightening the lacing system according to user preference. The pre-programmed conditions can even be evanescent based on the activity of the user. For instance, the lacing system can be tightened with each footfall as the user is running and then loosened as the foot leaves the ground. A similar approach can be used for lacing systems on ski bindings so that the lacing system is tightened during a turn and loosened during a jump, for instance. When the pre-programmed conditions are based on the user's activity, other sensors may be incorporated into a sensor module 36, such as an accelerometer or pressure sensor.

In another aspect, the controller 32 may incorporate a wireless communication component to communicate with an external device 40. The device 40 may be a hand-held device, such as a smart phone, that incorporates an app that allows the user to adjust the lacing system tension without having to manually actuate the BOA closure 12. This wireless remote operation of the controller can allow the use to make incremental adjustments in the tightness of the lacing system that cannot be accomplished by the discrete positions of the dial 13 of the closure 12. The remote communication also allows the user to make adjustments "on-the-fly" during an activity without having to stop the activity to manually actuate the closure 12.

Figure 6:
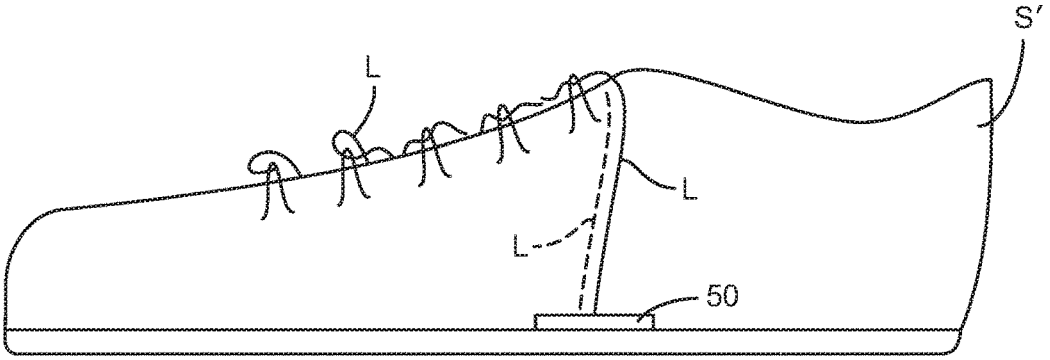
FIG. 6 is a side view of a show with a lacing system incorporating a tightening system according to one aspect of the present disclosure.
Figure 7:
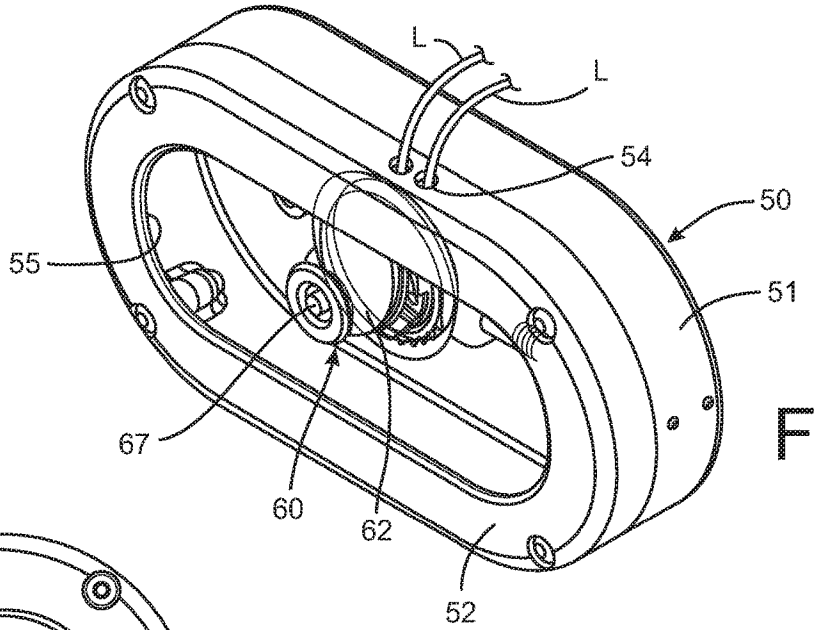
FIG. 7 is a perspective view of a lace tightening device according to one aspect of the present disclosure.
Figure 9:
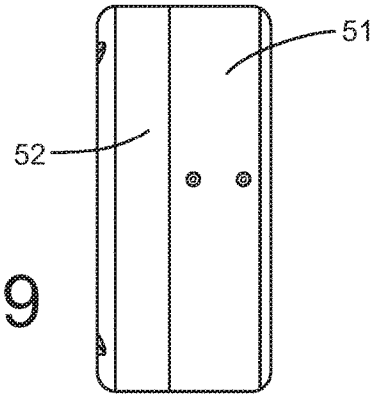
FIG. 9 is a side view of the lace tightening device shown in FIG. 7.
Figure 8:
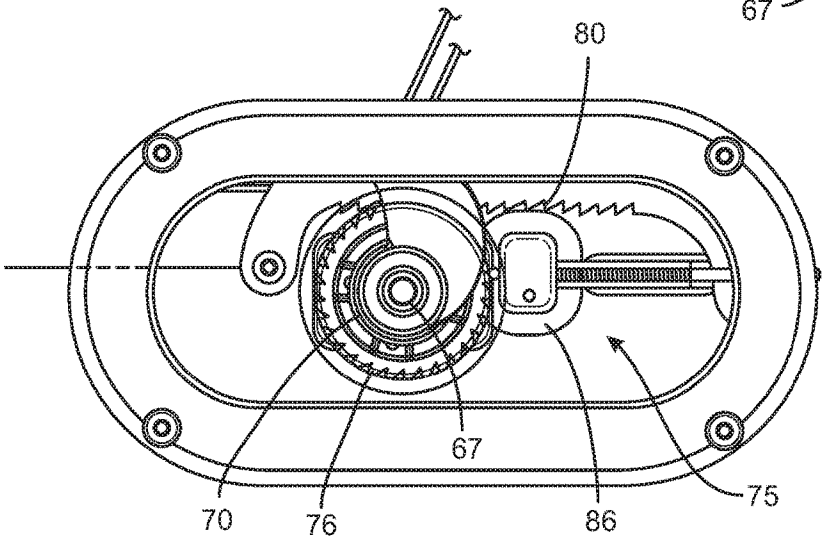
FIG. 8 is a top view of the lace tightening device shown in FIG. 7.

In another aspect of the present disclosure, a shoe S' shown in FIG. 6 is provided with a continuous lace L that is part of the conventional lacing system, except that in this aspect, the ends of the lace L are connected to a tightening device 50 mounted in the base or insole of the show S'. The opposite ends of the lace L are threaded through the material of the shoe S' at opposite sides of the show, converging on the tightening device 50.

Figure 10:
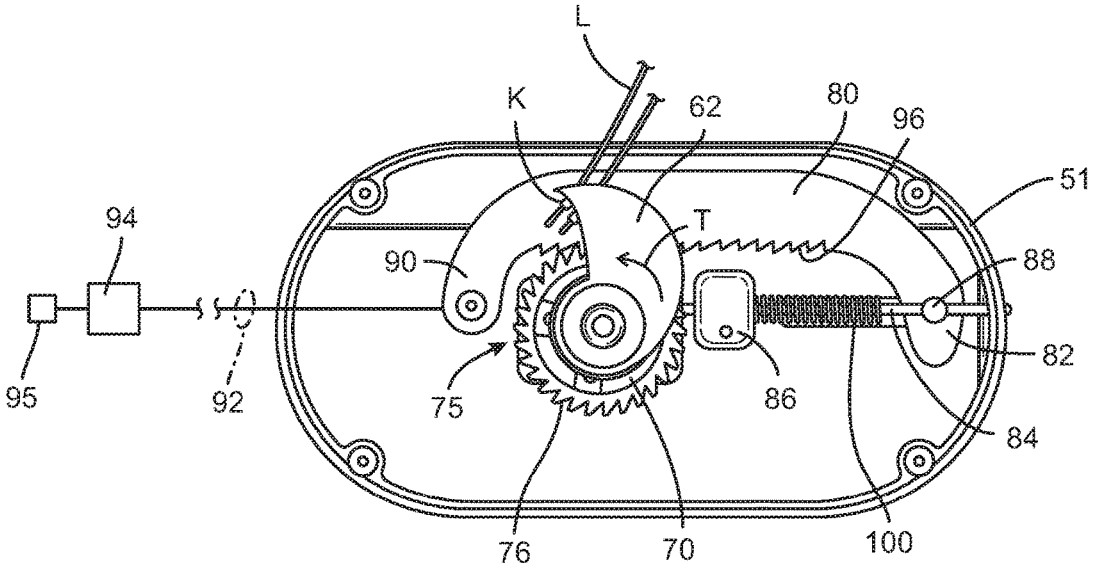
FIG. 10 is a top cut-away view of the lace tightening device shown in FIG. 7.
Figure 11:
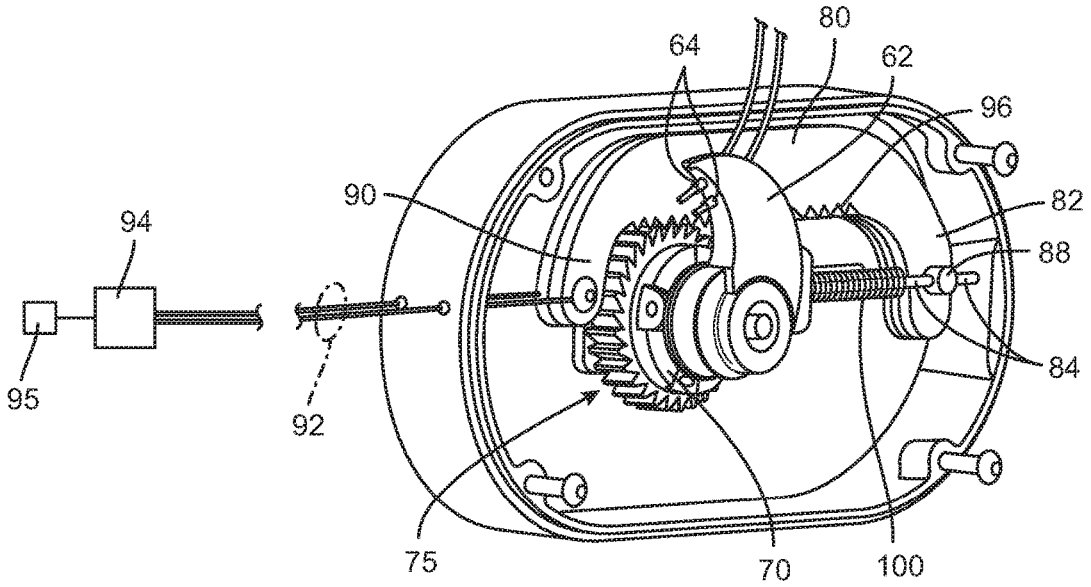
FIG. 11 is a perspective view of the cut-away view shown in FIG. 10.
Figure 13:
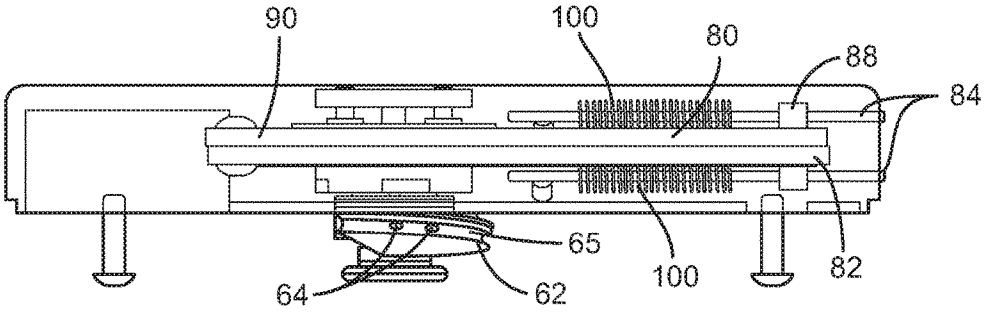
FIG. 13 is a top cut-away view of the view of the cut-away view shown in FIG. 10.
Figure 14:
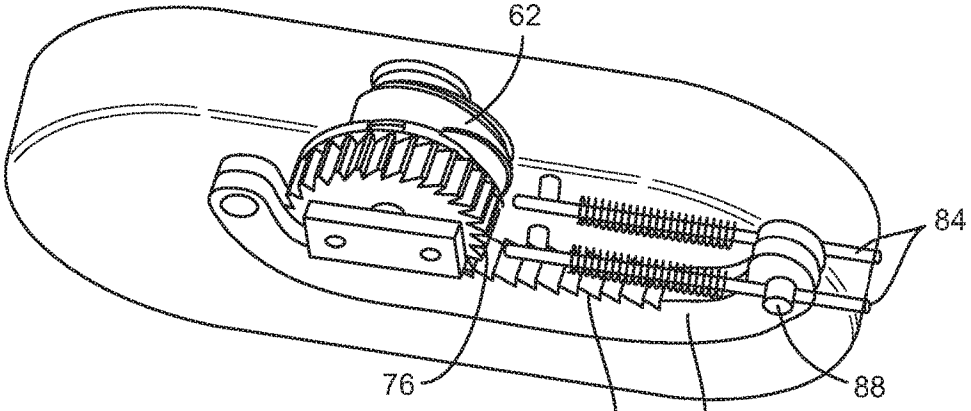
FIG. 14 is a bottom perspective cut-away view of the view of the cut-away view shown in FIG. 10.
Figure 12:
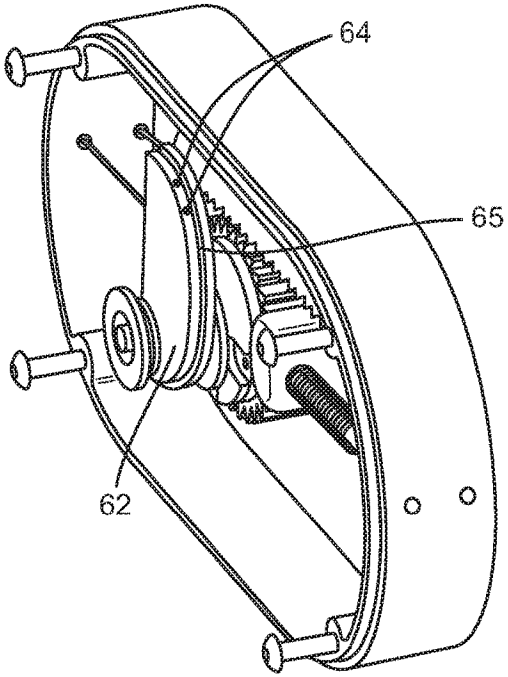
FIG. 12 is a further perspective view of the cut-away view shown in FIG. 10.
Figure 15:
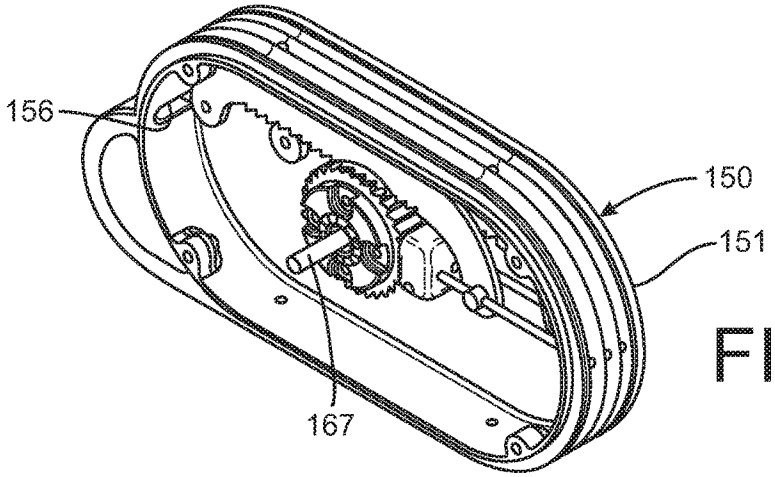
FIG. 15 is a perspective view of a lace tightening device according to a further aspect of the present disclosure.
Figure 17:
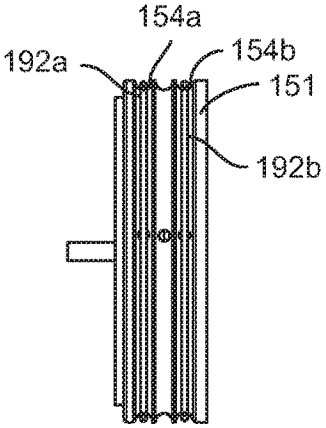
FIG. 17 is a side view of the lace tightening device shown in FIG. 15.

One embodiment of the tightening device 50 is shown in FIGS. 7-14. The device 50 includes a lower housing 51 connected to an upper housing 52. The upper housing 52 includes a pair of openings 54 for receiving the ends of the lace L. Alternatively, the upper housing 52 can include an opening 55 through which the ends of the lace may pass to engage the components of the device. In particular, the ends of the lace L are fastened to a rotating cam 62, as best shown in FIGS. 10-12. The cam 62 includes a pair of openings 64 through which the ends of the lace L are threaded. The lace ends can be knotted K or otherwise affixed to the cam 62 at the openings 64 so that the lace cannot be dislodged from the cam. As shown in FIG. 12, the cam includes one or two grooves 65 at its outer surface to receive the lace L as the cam rotates in the counter-clockwise direction T, as viewed in FIGS. 8, 10 and 11, during tightening of the lace.

The cam 62 is mounted on a shaft 67 of a one-way clutch device 70. The one-way clutch device 70 permits rotation of the cam 62 in the counter-clockwise direction T for tightening the lace, but prevents rotation in the opposite clockwise direction. The clutch device can be similar to the clutch device used in the BOA closure described above and as described in detail in U.S. Pat. No. 7,954,204, the disclosure of which is incorporated herein by reference. It is understood that other one-way clutch devices can be utilized. The one-way clutch device 70 can be released by pulling the cam 62, and thereby the shaft 67 outward away from the body of the device to disengage the ratcheting system of the device. When the one-way clutch device 70 is released the cam 62 is free to rotate in any direction, and particularly in the clockwise direction to loosen the lace L connected thereto.

In order to tighten the lace the device 50 of the present disclosure provides a mechanism 75 for incrementally rotating the cam 62. The mechanism 75 includes a gear 76 that is engaged with a ratchet arm 80. The ratchet arm 80 is generally U-shaped with one end 82 slidably mounted on one of more rods 84. The rods extend generally horizontally relative to the lower housing 51 between the housing and a mounting boss 86. The ratchet arm end 82 is connected to the rod(s) 84 by a bushing 88 that permits low-friction sliding on the rod(s). The opposite end 90 of the U-shaped ratchet arm 80 is attached to one or more SMA wires 92. The SMA wire(s) are connected to a controller 94 that energizes the SMA wire(s) to cause the length of the SMA wires to shrink, as described above. It can be appreciated that as the length of the SMA wire(s) 92 is reduced the wires effectively pull the arm 80 to the left in the figures.

The ratchet arm 80 includes a row of teeth 96 configured to mesh with the teeth of gear 76. As the ratchet arm 80 translates to the left it rotates the gear 76 in the counter-clockwise direction, thereby rotating the cam 62 and tightening the lace L. The device 50 of this embodiment thus utilizes the SMA wire described above to exert a pulling force on the lace L by way of the mechanism 75. In one aspect of the disclosure, the controller 94 is configured to energize the SMA wire (s) 92 in a stepwise manner so that the laces are incrementally tightened in a series of activations and releases of the SMA wire(s). When the SMA wire(s) is activated, it shrinks thereby pulling the ratchet arm 80 to the left and rotating the cam 62 counter-clockwise to incrementally tighten the lace L. The SMA wire is de-energized so that the wire rapidly returns to its original length. When the one-way clutch device 70 is engaged the clutch device holds the cam 62 in its new rotational position.

The controller 94 then reactivates the SMA wire(s) 92 to again pull the ratcheting arm to the left and to again rotate the cam in the tightening direction. The controller them again de-energizes the SMA wire(s), with the clutch device holding the arm 80 and cam 62 in their respective tightened positions, thereby maintaining tension on the lace L. This process continues until the laces have been tightened to the desired tension.

The controller 94 can be provided with a control button 95 that is mounted to the shoe S' for ready access by the user. As long as the button is actuated by the user the controller 94 continues to sequentially energize and de-energize the SMA wire to incrementally tighten the lace L as described above. It is further contemplated that the controller 94 may be configured to "learn" the degree of lace tightening desired by the user, thereby permitting "one-button" activation. In this configuration the controller "learns" how many cycles of activating and de-activating the SMA wire(s) produces the lace tightness desired by the user. It is further contemplated that the controller 94 can be configured to measure the length of the SMA wire(s) at the end of each activation cycle and then "remember" the reduced length of the SMA wire(s) at the lace tension desired by the user. In this approach, the controller 94 continuously measures the length and ceases the activation/de-activation cycle when the desired reduced length is reached. As yet another alternative, the controller 94 can incorporate a strain gage to measure the strain in the SMA wire(s) and to de-activate the device when the strain corresponding to the desired tightness is reached.

The tension in the lace L can be released by releasing the one-way clutch device 70. The mechanism 75 includes a spring arrangement 100 concentrically disposed on the rod(s) 84 and bearing on the end 82 of the ratcheting arm 80. As the arm moves to the left it successively compresses the spring arrangement 100. When the one-way clutch 70 is released the cam 62 is free to rotate in the opposite, loosening, direction. Since the gear 76 no longer restrains the ratchet arm, the spring 100 pushes the ratchet arm to the right, thereby rotating the gear and cam 62 in the clockwise direction, which loosens the lace L. Moreover when the SMA wire 92 is de-activated during the activation/de-activation cycle, the spring arrangement 100 exerts a force on the end 82 of the ratchet arm to return it to the position shown in FIG. 10 to ready the arm to be energized again to rotate the driven gear 76. The teeth on the gear 76 and teeth 96 on the ratchet arm are configured so that the ratchet teeth 96 slide across the gear teeth as the ratchet arm moves to its baseline position. Thus, in one embodiment, the front faces of the ratchet teeth 96 and the back faces of the gear teeth are angled toward the end 82 of the ratchet arm so that the ratchet arm teeth only engage the gear teeth when moving to the left in FIG. 10.

The device 50 is sized to be mounted within the base or insole of the shoe S' in a manner that does not interfere with the use of the shoe. The controller 94 for the SMA wire(s) 92 can also be embedded within the shoe, along with a power supply associated with the controller. The controller can execute software or firmware to execute the energization/de-energization cycle for the SMA wire(s). Due to the responsiveness of the SMA wire, the energization/de-energization cycle of the wire is measured in fractions of a second. In one embodiment, ratcheting arm 80 and SMA wire(s) 90 can be configured for a stroke of 0.125 inches with each energization/de-energization cycle. The lace L can be fully tightened in less than two seconds. Since the activation cycle for the SMA wire(s) is short there is minimal heat build-up.

In one alternative, multiple SMA wires can be attached to the single ratchet arm, with each wire being successively energized and de-energized. This approach maintains a constant pull on the ratchet arm since another wire is being energized even as the other(s) of the SMA wire(s) is de-activated.

In another embodiment, a lace tightening device 150 is shown in FIGS. 15-20. The device includes a lower housing 151 and an upper housing similar to the upper housing 52 shown in FIGS. 7-8. The tightening device 150 includes a cam like the rotating cam 62 in the previous embodiment of FIGS. 7-14, with the understanding that the cam is mounted on the shaft 67 of the one-way clutch device 170. The one-way clutch device 170 and gear 176 can be similar to the clutch device 70 and gear 76 of the previous embodiment, it being understood that these components operate in the same manner to apply tension to a lace in a manner similar to the lace L in the previous embodiment.

While the lace tightening device 150 operates in a similar manner to the device 50, the device 150 includes two SMA wires 192*a*, 192*b* that operate on separate ratchet arms 180, 180*b*. Each ratchet arm 180*a*, 180*b* is slidably supported by a respective rod 184 mounted between the lower housing 151 and a mounting boss 186. Although not shown, the rods may also include a corresponding concentrically mounted spring arrangement for applying a return force to the arms 180*a*, 180*b* when the one-way clutch device 170 is released, as described above. Each ratchet arm includes linear teeth for engaging the gear 176 so that the gear is rotated counter-clockwise as the ratchet arm is pulled to the left in FIG. 16.

In accordance with the present disclosure, each SMA wire 192*a*, 192*b* is connected to a controller, such as the controller 95 of the previous embodiment, that is configured to alternately activate and de-activate each of the SMA wires in turn, meaning that only one wire is activated at a time. In other words, when wire 192*a* is activated, wire 192*b* is de-activated, and when wire 192*b* is activated, wire 192*a* is de-activated. It can be appreciated that with this approach the gear 176 is being continuously rotated. As one wire reaches the end of its respective stroke, it is de-energized but the other wire is then energized to move to the end of its stroke. This approach reduces the amount of time to fully tighten the lace L to the user's specifications by about half from the previous embodiment.

Figure 16:
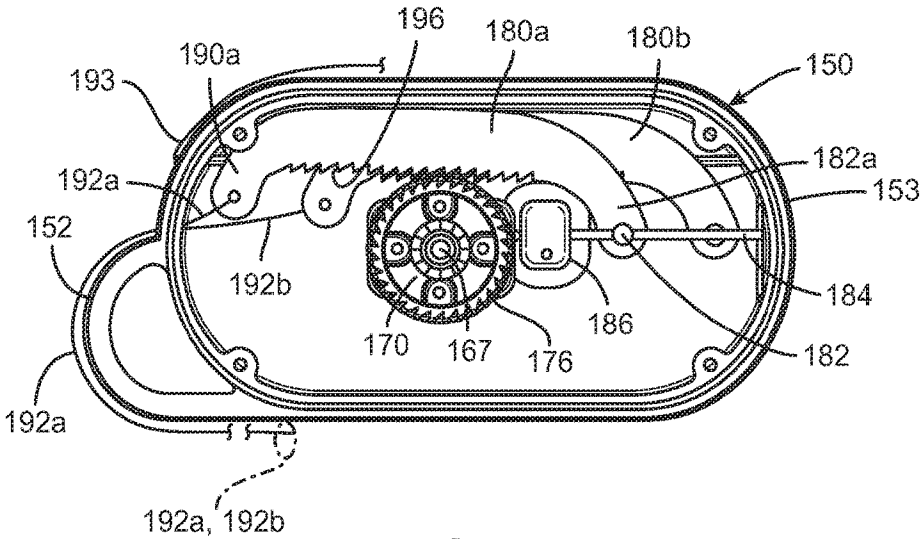
FIG. 16 is a top view of the lace tightening device shown in FIG. 15.
Figure 18:
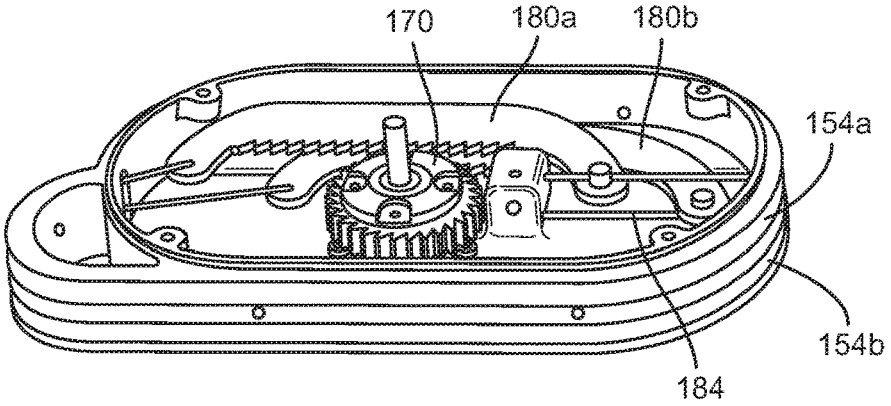
FIG. 18 is a bottom perspective view of the lace tightening device shown in FIG. 15.
Figure 19:
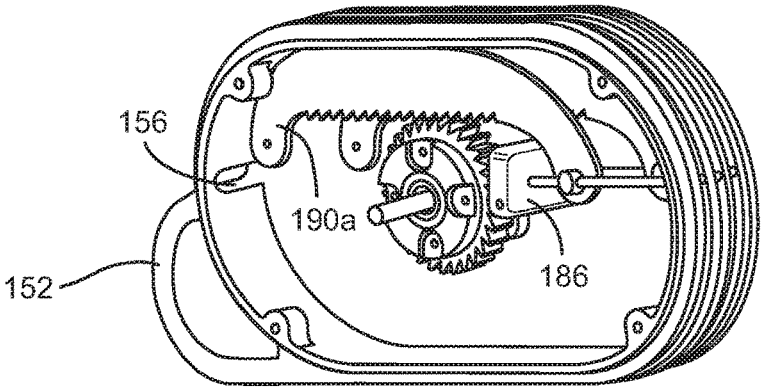
FIG. 19 is a side perspective view of the lace tightening device shown in FIG. 15
Figure 20:
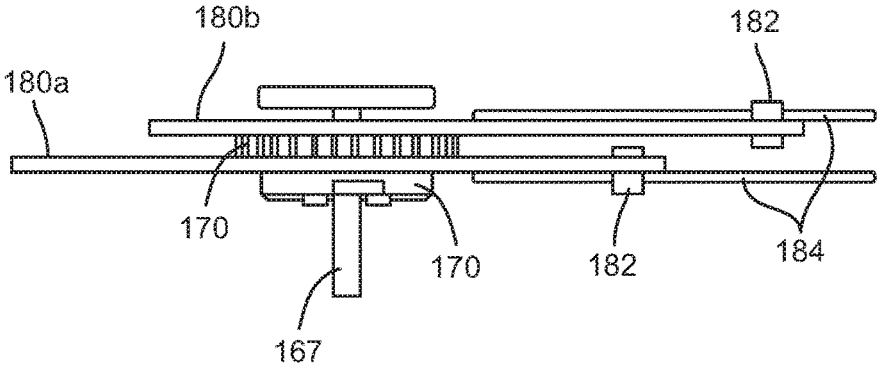
FIG. 20 is a top cut-away view of the lace tightening device shown in FIG. 15.
Figure 21:
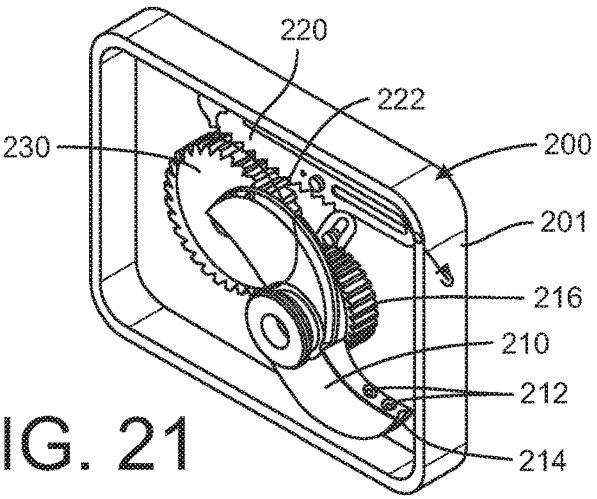
FIG. 21 is a perspective view of another lace tightening device according to the present disclosure.

In a further feature of this embodiment, the SMA wires 192*a*, 192*b* are wound around the outside surface of the bottom housing 151. Thus, as shown in FIG. 16, the SMA wire 192*a* is shown slightly off the surface of the housing to illustrate that it is wound around the housing and anchored at a point 193. The housing thus defines a pair of tracks 154*a*, 154*b* around the outside of the housing that receives a corresponding one of the SMA wires 192*a*, 192*b*. As shown in FIG. 19, the SMA wires exit the interior of the housing through a window 156. The housing defines a bulge 152 immediately adjacent the window 156 so that the SMA wire can be immediately disposed within its corresponding track 154*a*, 154*b*. The bulge then winds 180° to the base of the bottom housing. This approach eliminates any bending or kinking of the SMA wires and allows the wires to follow a smoothly curving path to be wrapped around the housing. This approach further allows the SMA wires 192*a*, 192*b* to have sufficient length to shorten by a sufficient amount upon activation. It is known that the amount of shortening of an SMA wire is a function of its overall length, so this approach allows an optimum length of the wires while maintaining the SMA wires in a limited envelop and providing the entire device 150 in a small package.

The controller for executing the power cycle for the two SMA wires can be incorporated into the housing so that the device 150 forms a self-contained unit. It is further contemplated that a third ratchet arm and a third SMA wire can be incorporated into the device. In that instance, each of the three ratchet arms would be activated in sequence to provide even more rapid rotation of the driven gear and cam, and even quicker tightening of the lace.

In an alternative embodiment of the present disclosure, a lace tightening device 200 incorporates a different mechanism for releasing the tightened shoe lace. In this embodiment, a ratchet arm 220 drives a gear 230 in a manner similar to the other embodiments, in particular by actuation of one or more SMA wires 225 connected at the end 221 of the arm to move the arm to the left. A slot 222 in the arm guides the arm within the housing 201 and a spring arrangement 227 is fastened to the end 223 of the arm to provide a return force between cycles.

Figure 23:
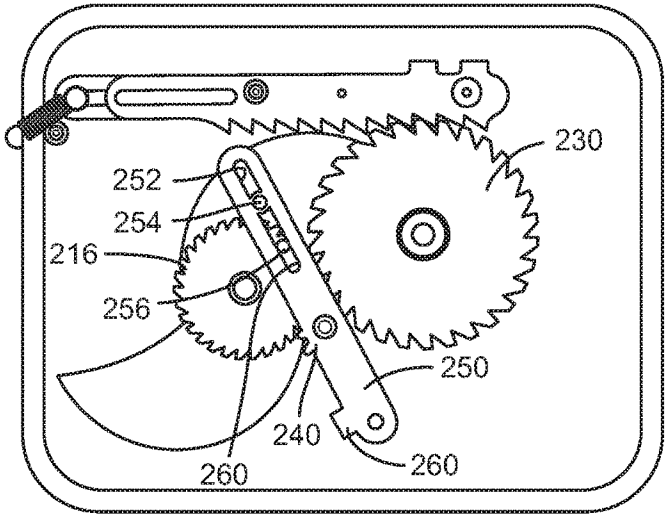
FIG. 23 is a bottom cut-away view of the lace tightening device shown in FIG. 21.
Figure 22:
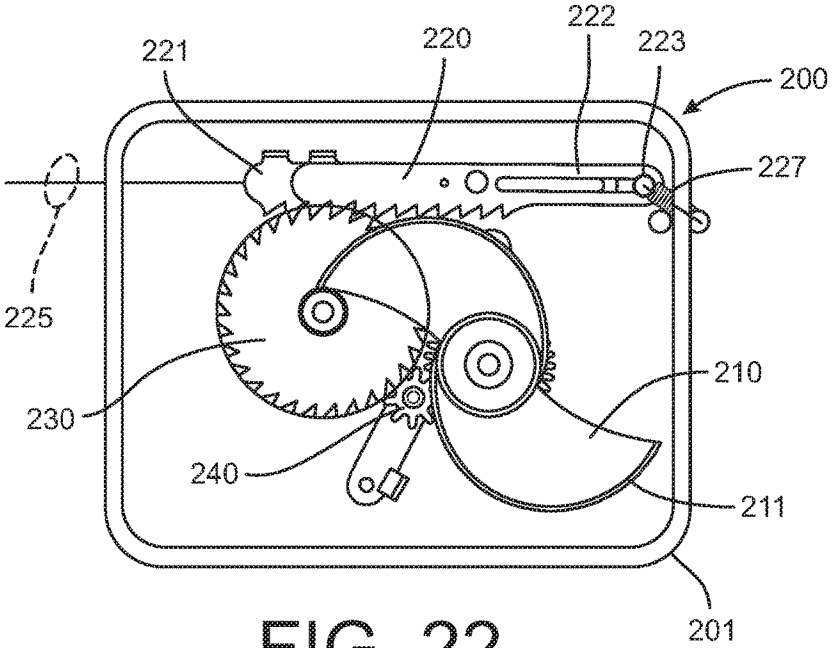
FIG. 22 is a top view of the lace tightening device shown in FIG. 21.

As best shown in FIG. 23, the device 200 does not use a clutch mechanism, as in the previous embodiments. Instead, the device includes an idler gear 240 between the gear 230 and a driven gear 216 fastened to or integral with the cam 210. In this embodiment, the cam 210 can include two lobes for connection to the opposite ends o the lace L through openings 212 in the cam. The cam surface includes a groove 214 for receiving the lace. The idler gear 240 transmits rotation of the gear 230 caused by movement of the ratchet arm 220 to the gear 216 of the cam so that the cam rotates in the same direction as the gear 230 to tighten the lace. The idler gear 240 is carried by an arm 250 that is guided by pins 254, 256 disposed within a slot 252 of the arm. A tab 260 provides an attachment point for a release lever or cable (not shown), so that pulling on the tab 260 moves the arm 250 and thus the idler gear 240 out of engagement between the two gears 230, 216. The cam gear 216 thus becomes essentially free-wheeling so that the lace L can be readily loosened simply by pulling on the lace.

Figure 25:
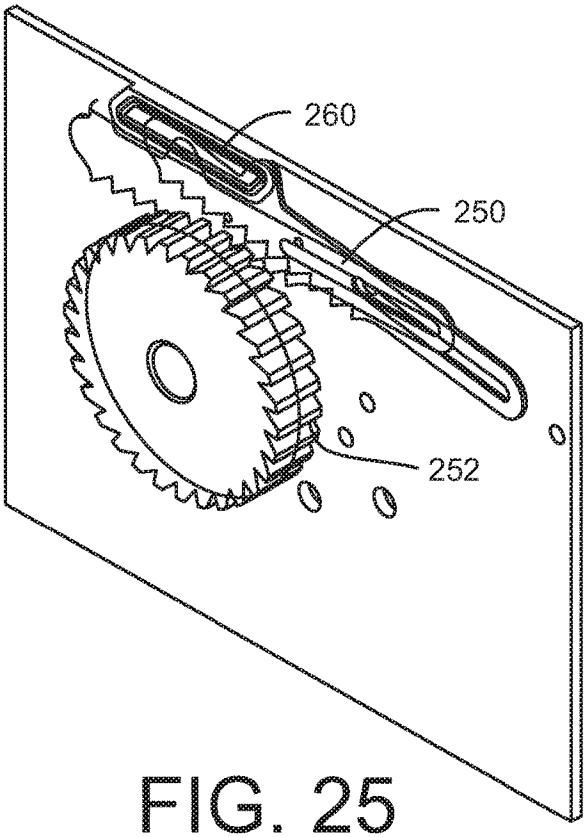
FIG. 25 is a perspective view of the mechanism shown in FIG. 24.
Figure 24:
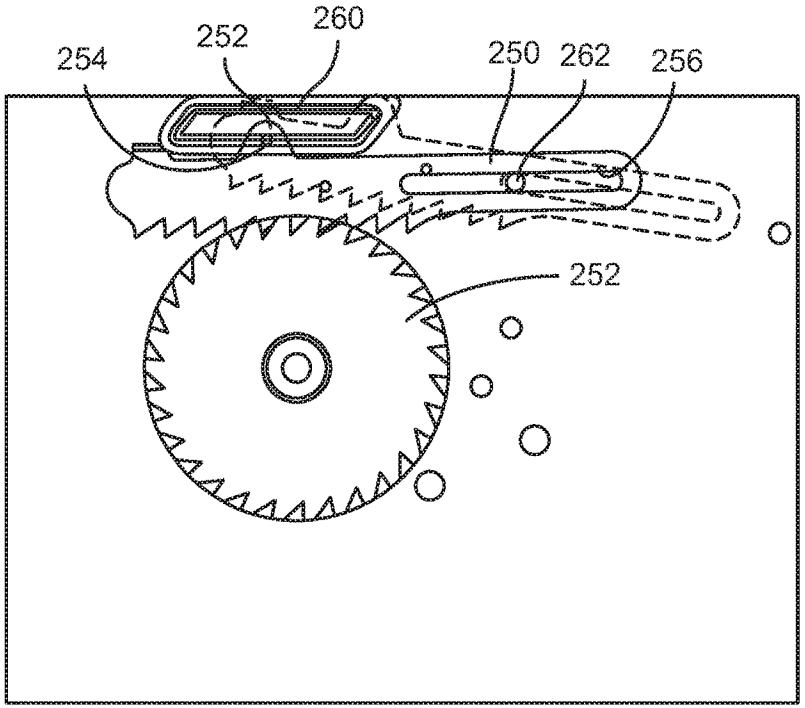
FIG. 24 is a top view of a lace tightening mechanism for use on a lace tightening device according to the present disclosure.

In a further embodiment shown in FIGS. 24-25, the ratchet arm 250 can be slidably mounted within the housing to engage the gear 252, which can be the same as the gears 76 and 176 above. The arm can include a slot 256 that is mounted over a guide pin 262 that is fastened to the housing. The arm 250 includes a tab 254 with a pin 252 that is disposed within a closed track 260 defined in a wall of the housing. The closed track guides the vertical movement of the arm 250 as the arm moves through a cycle while being pulled by the SMA wire(s). It can thus be appreciated that the pin 252 causes the end of the arm to move upward and the entire arm to pivot about the guide pin 262, as shown in phantom lines in FIG. 24. This movement is followed during each stroke of the ratchet arm 250.

The present disclosure should be considered as illustrative and not restrictive in character. It is understood that only certain embodiments have been presented and that all changes, modifications and further applications that come within the spirit of the disclosure are desired to be protected. For instance, although the embodiments disclosed herein relate to a lacing system for a shoe, the systems and devices disclosed herein can be used for other lacing systems for other objects, devices or products.

What is claimed is:

1. A lace-tightening device for a shoe lace in a shoe comprising:

a housing configured to be mounted within the shoe, the housing define at least one opening for receiving the opposite ends of the shoe lace;

a rotating cam disposed within the housing and adapted for connection to the opposite ends of the shoe lace, the cam including an outer surface for receiving the shoe lace as the cam rotates;

a driven gear disposed within the housing;

a one-way clutch rotatably coupling said driven gear to said rotating cam so that rotation of said driven gear in one direction rotates said cam in said one direction, thereby tightening the shoe lace connected to the rotating cam;

a ratchet arm slidably disposed within the housing, said ratchet arm including linear teeth arranged to engage the teeth of the driven gear as the ratchet arm translates in a linear direction to rotate said driven gear in said one direction; and at least one shape memory alloy (SMA) wire attached at one end of the wire to the ratchet arm and at an opposite end of the wire to a controller, the controller configured to execute a power cycle to energize and deenergize the SMA wire so that the wire sequentially shrinks and returns to its original length to sequentially translate the ratchet arm in said linear direction while in engagement with said driven gear.

2. The lace-tightening device of claim 1, wherein the ratchet arm is elongated with one end slidably supported within said housing.

3. The lace-tightening device of claim 2, wherein said one opposite end of said ratchet arm is slidably supported on an elongated rod, and a spring arrangement is concentrically disposed on said rod to exert a force on said one end of said ratchet arm in a direction opposite said linear direction.

4. The lace-tightening device of claim 1, wherein the teeth of said driven gear and said teeth of said ratchet arm are configured so that said teeth of said ratchet arm only engage the teeth of the driven gear when the ratchet arm moves in said linear direction.

5. The lace-tightening device of claim 1, wherein said controller includes a control button mounted to the shoe to be manually actuated to activate said controller to execute the power cycle.

6. The lace-tightening device of claim 1, wherein said one-way clutch is configured to be released to permit the driven gear and thus said rotating cam to be rotated in a direction opposite said one direction.

7. The lace-tightening device of claim 1, further comprising:

a second ratchet arm slidably disposed within the housing, said second ratchet arm including linear teeth arranged to engage the teeth of the driven gear as the second ratchet arm translates in a linear direction to rotate said driven gear in said one direction; and a second SMA wire attached at one end of the wire to said second ratchet arm and at an opposite end of the wire to said controller, wherein said controller is configured to alternate executing the power cycle between the two ratchet arms.

8. The lace-tightening device of claim 1, wherein said housing defines a channel on the outside surface thereof and said at least one SMA wire is wound around the outside surface of the housing within said channel.

9. The lace-tightening device of claim 1, wherein the SMA wire is formed of Nitinol.

10. The lace-tightening device of claim 1, wherein the device is sized to be disposed within the sole of the shoe.

11. A device for tightening an elongated lace having opposite ends, the device comprising:

a housing defining at least one opening for receiving at least one of the opposite ends of the lace;

a rotating cam disposed within the housing and adapted for connection to at least one of the opposite ends of the lace, the cam including an outer surface for receiving the lace as the cam rotates;

a driven gear disposed within the housing;

a one-way clutch rotatably coupling said driven gear to said rotating cam so that rotation of said driven gear in one direction rotates said cam in said one direction, thereby pulling the lace connected to the rotating cam;

a ratchet arm slidably disposed within the housing, said ratchet arm including a line of teeth arranged to engage the teeth of the driven gear as the ratchet arm translates within the housing to rotate said driven gear in said one direction; and at least one shape memory alloy (SMA) wire attached at one end of the wire to the ratchet arm and at an opposite end of the wire to a controller, the controller configured to execute a power cycle to energize and deenergize the SMA wire so that the wire sequentially shrinks and returns to its original length to sequentially translate the ratchet arm while in engagement with said driven gear.

12. The device of claim 11, wherein said one-way clutch is configured to be released to permit the driven gear and thus said rotating cam to be rotated in a direction opposite said one direction.

13. The device of claim 11, further comprising:

a second ratchet arm slidably disposed within the housing, said second ratchet arm including a line of teeth arranged to engage the teeth of the driven gear as the second ratchet arm translates to rotate said driven gear in said one direction; and a second SMA wire attached at one end of the second wire to said second ratchet arm and at an opposite end of the wire to said controller, wherein said controller is configured to alternate executing the power cycle between the two ratchet arms.

* * * * *